US008870090B2

(12) United States Patent
Feriani et al.

(10) Patent No.: US 8,870,090 B2
(45) Date of Patent: Oct. 28, 2014

(54) VOLATILE LIQUID DROPLET DISPENSER DEVICE

(75) Inventors: Amir Feriani, Auvernier (CH); Joseph Hess, Bevaix (CH)

(73) Assignee: Aptar France SAS, Le Neubourg (FR)

( * ) Notice: Subject to any disclaimer, the term of this patent is extended or adjusted under 35 U.S.C. 154(b) by 500 days.

(21) Appl. No.: 12/024,310

(22) Filed: Feb. 1, 2008

(65) Prior Publication Data

US 2008/0217430 A1 Sep. 11, 2008

(30) Foreign Application Priority Data

Feb. 1, 2007 (EP) ..... 07002190

(51) Int. Cl.
*B05B 1/08* (2006.01)
*B05B 17/00* (2006.01)
*B05B 17/06* (2006.01)

(52) U.S. Cl.
CPC ..... *B05B 17/0646* (2013.01); *B05B 17/0684* (2013.01)
USPC ..... 239/102.2; 239/102.1

(58) Field of Classification Search
CPC ..... B05B 17/0646; B05B 17/0638; B05B 17/063; B05B 17/06; B05B 17/04
USPC ..... 239/102.1, 102.2, 4
See application file for complete search history.

(56) References Cited

U.S. PATENT DOCUMENTS 3,900,162 A 8/1975 Titus et al.
4,667,877 A * 5/1987 Yao et al. ..... 239/102.2
4,667,977 A 5/1987 Lacroix
4,702,418 A 10/1987 Carter et al.
4,923,448 A 5/1990 Ennis, III
5,792,941 A * 8/1998 Rye et al. ..... 73/53.01
6,196,219 B1 3/2001 Hess et al.
6,341,732 B1 1/2002 Martin et al.

(Continued)

FOREIGN PATENT DOCUMENTS

EP 0 516 565 A1 12/1992
EP 0923957 A1 6/1999
EP 1 092 541 A2 4/2001
EP 1129741 A2 9/2001
EP 1273355 A1 1/2003

(Continued)

OTHER PUBLICATIONS

Delphion Integrated View Corresponding to EP 1129741A2, "Spray Device for an Inhaler," downloaded Mar. 3, 2010, Exhibit A.

(Continued)

*Primary Examiner* — Jason Boeckmann
(74) *Attorney, Agent, or Firm* — Griffin & Szipl, P.C.

(57) ABSTRACT

A volatile liquid droplet dispenser device includes: a first substrate (1) having a space (2*c*) for containing a liquid substance, and having liquid outlet means (2*a*) for ejecting the liquid substance; a second substrate (3) having a liquid inlet means (3*i*) for allowing the liquid substance to enter said device; an actuating element (2*b*, 8, 10) arranged to actuate the liquid substance so as to exit the device as a liquid droplet spray, wherein the liquid outlet means (2*a*) of the first substrate comprises a perforated nozzle membrane (2*a*) having a plurality of outlet nozzles, and wherein the first substrate (1) contains at least one fluidic capillary priming channel (1*a*, 1*b*, 1*c*) arranged to receive liquid substance from the space (2*c*) so as to fill the channel such that the liquid substance is in close proximity to the outlet nozzles for priming the liquid substance for ejection through the nozzle membrane.

16 Claims, 15 Drawing Sheets

(56) References Cited

U.S. PATENT DOCUMENTS

| | | | | |
|---|---|---|---|---|
| 6,378,780 | B1 * | 4/2002 | Martens et al. | 239/102.2 |
| 6,439,474 | B2 | 8/2002 | Denen | |
| 6,443,366 | B1 * | 9/2002 | Hirota et al. | 239/102.2 |
| 6,536,682 | B1 | 3/2003 | Schnupp et al. | |
| 6,554,201 | B2 | 4/2003 | Klimowicz et al. | |
| 6,722,582 | B2 | 4/2004 | Hess et al. | |
| 6,732,944 | B2 | 5/2004 | Litherland et al. | |
| 6,766,817 | B2 | 7/2004 | da Silva | |
| 6,802,460 | B2 | 10/2004 | Hess et al. | |
| 6,918,404 | B2 | 7/2005 | da Silva | |
| 6,926,208 | B2 | 8/2005 | Ivri | |
| 7,066,398 | B2 | 6/2006 | Borland et al. | |
| 7,066,586 | B2 | 6/2006 | da Silva | |
| 7,244,398 | B2 | 7/2007 | Kotary et al. | |
| 7,285,255 | B2 | 10/2007 | Kadlec et al. | |
| 2002/0162551 | A1 * | 11/2002 | Litherland | 128/200.14 |
| 2002/0162898 | A1 * | 11/2002 | Klimowicz et al. | 239/102.1 |
| 2002/0175220 | A1 | 11/2002 | Pence | |
| 2004/0082076 | A1 * | 4/2004 | Zengerle et al. | 436/180 |
| 2004/0124173 | A1 | 7/2004 | Hess et al. | |
| 2004/0263567 | A1 | 12/2004 | Hess et al. | |
| 2005/0001050 | A1 * | 1/2005 | Takagi et al. | 239/4 |
| 2005/0201870 | A1 | 9/2005 | Koerner et al. | |
| 2008/0015531 | A1 | 1/2008 | Hird et al. | |
| 2009/0084867 | A1 | 4/2009 | Hess et al. | |

FOREIGN PATENT DOCUMENTS

| | | | |
|---|---|---|---|
| EP | 1602414 | A2 | 12/2005 |
| EP | 1604701 | A1 | 12/2005 |
| EP | 1 952 896 | A1 | 8/2008 |
| WO | 95/15822 | A1 | 6/1995 |
| WO | 03068413 | A1 | 8/2003 |
| WO | 2004031580 | A1 | 4/2004 |
| WO | 2005024967 | A1 | 3/2005 |
| WO | 2005097349 | A1 | 10/2005 |
| WO | 2007062698 | A1 | 6/2007 |

OTHER PUBLICATIONS

Delphion Integrated View Corresponding to EP1273355A1, "Method of Manufacturing a Liquid Droplet Spray Device and Such Spray Device," downloaded Mar. 3, 2010, Exhibit B.

Delphion Integrated View Corresponding to EP1604701A1, "Improved Modular Liquid Spray System," downloaded Mar. 3, 2010, Exhibit C.

International Search Report, issued in corresponding application No. EP 08157455.0, completed Oct. 7, 2008, mailed Oct. 14, 2008.

E-mail from Elson da Silva discussing "Know-How and IP in Appliced Hydrology," sent Sep. 11, 2008.

International Search Report issued in corresponding European Application No. 07 00 2190, completed Apr. 3, 2007.

Hans C. Ohanian, Physics, 452-461, W.W. Norton & Co. 1985.

Random House Webster's College Dictionary 845 (1991).

McGraw-Hill Dictionary of Scientific and Technical Terms 663 (1978).

Hans C. Ohanian, Physics, 390-395 (1985).

Office Action issued in co-pending related U.S. Appl. No. 12/095,695 on Oct. 10, 2013.

Final Office Action issued in co-pending related U.S. Appl. No. 12/477,646 on Feb. 22, 2013.

Hans C. Ohanian, Physics 356-359 (W.W. Norton & Co., Inc. 1985), filed herewith as Exhibit A2.

Random House Webster's College Dictionary 87, 903 and 1295 (1991), filed herewith as Exhibit B2.

Stephen F. Pond, Inkjet Technology and Product Development Strategies 105-108 (Torrey Pines Research 2000), filed herewith as Exhibit C2.

"Vibration Induced Drop Atomization (VIDA)" at http://www.me.gatech.edu/bvukasinovic/VIDA.html, downloaded Aug. 1, 2011 (one page), filed herewith as Exhibit D2.

"VIDA Dynamics" at http://me.gatech.edu/bvukasinovic/VIDAdynamics.html, downloaded Aug. 1, 2011 (2 pages), filed herewith as Exhibit E2.

Random House Webster's College Dictionary 130 (1991).

E-Mail from Elson Silva, "Respecting Hydrology Science—US Pat. Application 20110036921", ECOLAB, Inc., dated Feb. 17, 2011, pp. 1-6.

Office Action issued in co-pending U.S. Appl. No. 12/477,646, dated Mar. 8, 2011.

Office Action mailed Apr. 9, 2014 in co-pending related U.S. Appl. No. 12/095,695.

* cited by examiner

VOLATILE LIQUID DROPLET DISPENSER DEVICE

This application claims priority from European Patent Application No. 07 002 190.2, filed Feb. 1, 2007, the entire disclosure of which is incorporated herein by reference.

FIELD OF THE INVENTION

The present invention relates to a droplet dispensing device.

BACKGROUND OF THE INVENTION

Such droplet dispensing devices are also sometimes called aerosol generators, nebulizers and the like. They normally contain a nozzle body on a support part, in particular, a nozzle body of a liquid droplet spray device which dispenses a liquid substance as a liquid droplet spray or from the device through the nozzles of the nozzle body. They further consist of an actuator based on a vibrating element which generally causes the liquid to vibrate, to be accelerated and expelled as droplets. They further consist of elements such as liquid space, liquid feed and fluid interface to a reservoir, a reservoir as well as electrical connections between the vibrating element and a corresponding electronic circuitry. The elements may be contained in the aforementioned support part, in a further support part or they may be contained in a number of support parts. The support part or parts and elements need to be manufactured and assembled with the actuator and the vibrating element. The liquid may be for example an ambient fragrance, a perfume, an insecticide, a liquid pharmaceutical formulation, aqueous based liquids and flammable or combustible liquids.

Such nozzle bodies are sometimes called aperture plates, nozzle arrays, dosing aperture, orifice plate, vibratable membrane member, dosing aperture arrangement, aerosol generator and the like. The terms are hence to be understood as being interchangeable throughout the present document.

In fact such nozzle bodies and droplet spray devices are well known. For example see the document EP 1 129 741 in the name of the present Applicant. This document describes a liquid droplet spray device having a top substrate formed of a main body and of a nozzle body. The nozzle body contains a nozzle array of liquid droplet outlet means allowing a liquid substance contained in the liquid droplet spray device to exit the device, in this case as a spray of droplets. The nozzle body is conventionally formed of a nozzle array made out of silicon, a polymer, a resin such as SU-8, Nickel, a metal alloy, Parylen, Duroplast or any suitable material or combination of these and other materials that allows for a sufficiently precise and cost-effective manufacturing of the outlet nozzle array. Beyond well-known silicon, metal and SU-8 resin micromachining methods the nozzle array could also be produced by methods using tools made with silicon micro-machining and other known replication methods like LIGA (Lithography-Galvano forming), hot embossing, UV printing, polymer and powder micro-injection moulding, micro-EDM and similar advanced 3D micro-machining methods and suitable combination of methods using photolithography and micro-structuring of resins, silicon, metal and plastic.

The documents U.S. Pat. No. 6,722,582 and EP 1 273 355 also in the name of the present applicant disclose such micromachining methods.

The document U.S. Pat. No. 6,536,682 shows an actuator component for a piezo-electrically driven atomizer which features a vibrating diaphragm formed specifically in a semiconductor substrate on which the liquid is suitably fed and atomised according to the capillary wave theory, i.e. at an vibration frequency in excess of 2 MHz. The device uses one single large aperture since at these frequencies nozzles are not needed to create the aerosol, droplets are directly formed from the free surface of the liquid according to the capillary wave theory. No nozzles in principle means no opportunity of clogging, open aperture in principle means that the device can leak if not in a horizontal position or closed off. According to the disclosure the device is supplied with liquid from an excess pressure container. It appears that a semiconductor substrate would be an expensive material just to produce a membrane on which to join a piezoelectric element for providing ultrasonic vibration.

The document U.S. Pat. No. 7,066,398 discloses the manufacturing method of a particular aperture plate by means of an electrically conductive mandrel on which nonconductive islands have been formed from a photo-resistant material using a photolithography process. By placing the mandrel in a galvanic bath containing the desired material for the aperture plate, the material is deposited and grows on the conducting areas whereas the non-conductive islands will form the aperture openings according to their particular shapes. After one or more deposition steps, the aperture plate can then be released from the mandrel and shaped as desired.

The document U.S. Pat. No. 6,802,460, in the name of the present Applicant, shows another example of a nozzle body attached to a main body allowing for ejection of liquid from the device through the nozzle of the nozzle body.

The document PCT/EP2006/006059, also in the name of the present Applicant, shows such a droplet spray device including the nozzle body, the support parts and the actuator containing the vibrating element as well as a general way of assembling such a device.

Documents US 2004/0263567 and EP-A-1 604 701 also in the name of the present Applicant, show examples of various device configurations for which such a droplet spray device can be produced and needs to be assembled into in an efficient and cost-effective manner.

The complete disclosures of document PCT/EP2006/006059, and its corresponding U.S. patent application Ser. No. 12/095,695, are herein incorporated by reference. Likewise, U.S. Pat. No. 6,802,460, US 2004/0263567, U.S. Pat. No. 6,722,582, and EP 1 273 355 and U.S. Patent Application Publication No. US 2004/0124173 A1 (which corresponds to EP 1 273 355) are herein incorporated by reference. Also, EP 1 129 741 and its corresponding U.S. Pat. No. 6,196,219, and EP-A-1 604 701 and its corresponding U.S. Patent Application Publication No. US 2009/0084867 A1, are herein incorporated by reference.

As can be seen from the cited prior art documents, all of them approach mainly a particular aspect of the manufacturing of a particular component of the respective droplet spray devices, but fail to take a total device approach to the industrial production and assembly of components and device. In fact these devices, together with others fall into the category of Multi-Material-Electro-Mechanical Systems. Generally, the construction, the production and the assembly of such devices requires to dominate several main criteria or problems which additionally to attaining the lowest possible cost may present contradictory effects and conditions.

The effects and conditions firstly refer to the need to provide capillary feed or feed at very low pressures well below one mbar (100 Pa) or fractions thereof. Capillary feed for some liquids will refer to liquid channel, chamber and other fluid handling structures or features with dimensions of a few hundred microns to below 100 μm, often in the range of 10 to 50 μm, absolute evenness and smoothness of wetted surfaces and absence of dead spaces, corners and pockets in order to avoid even minute bubble traps. These bubbles, consisting of air surrounded by an ultra-thin film of the liquid, tend to block the capillary feed, hence the device functionality in a very effective manner.

The second problem is that leak-tightness needs to be guaranteed for a variety of liquids. Leak-tightness normally implies rigid body construction and assembly of its components and long-term resistance of the components to sometimes aggressive solvents.

The third problem is to assemble the actuator in a way which provides the most efficient use of the ultrasonic energy delivered by the vibrating element, namely a piezoelectric element.

A further problem is the aforementioned lowest possible production cost together with a minimum of assembly operations in simple, reliable assembly steps.

A further problem is represented by the need to disassemble the droplet spray device after one or several uses in order not to discard all parts after use, but to discard only one part and to keep the others for further use after cleaning for example or to disassemble some parts for cleaning them periodically and to reassemble them again for further use.

As can be understood by the person skilled in the art, these criteria can be highly contradictory in their requirements and effects. Also, as said before none of the prior art devices discloses on how to achieve these contradictory criteria in one device or a family of devices.

Other prior art devices have addressed in more detail some individual problem areas. For example, document U.S. Pat. No. 6,554,201 discloses a method for producing an aerosol generator comprising a vibratable element, a vibratable member and a support member. The vibratable member itself contains a plurality of apertures that are configured to produce liquid droplets when a liquid is applied to the rear surface of the vibratable member and the vibratable member is vibrated at ultrasonic frequencies by the vibratable element comprising an annular piezoelectric element. The document further discloses over-moulding the vibratable member and the vibratable element with the support member, all elements being essentially concentric. The document further discloses the introduction of an annular and concentric stiffening element such as a washer and different sizes materials for the stiffener to produce different flow rates. The document is silent about how the liquid is applied to the rear surface of the vibratable member and if and how leak-tightness and optimal fluidic behaviour can be achieved with this construction.

Document U.S. Pat. No. 6,732,944 discloses an aerosol generator having a vibrating element on a vibratable member with a front, a rear, a plurality of apertures traversing from rear to front, an outer periphery and a support element disposed about the outer periphery. The document further discloses an isolating structure coupled to the support element in order to vibrationally isolate the vibrating element from the support structure. The document discloses that metal arms, elastomeric bushings, plastic legs and the like and materials such as silicone, urethane, elastomers and metals can be used, but is in general silent about how this feature can be integrated into a final device providing leak-tightness, fluidic optimization and low cost integration.

Document U.S. Pat. No. 6,926,208 discloses a fluid injection device with an aperture plate having an oscillating surface with tapered apertures thereon and various relatively complex combinations of fluid supply to the oscillating surface. Again this document is in general silent about how this feature can be integrated into a final device providing leak-tightness, fluidic optimization and low cost integration.

The previously cited document U.S. Pat. No. 7,066,398 discloses how the aperture plate is coupled to a supporting member having a piezoelectric transducer coupled thereon and an interface to couple the resulting fluid injection device to other components of the device. But the document is again silent about how this feature can be integrated into a final device providing leak-tightness, fluidic optimisation and low cost integration.

Document WO 03/068413 discloses a liquid spray-head comprising a flexible member surrounding a liquid ejecting member and thus flexibly connecting the liquid ejecting member to the device housing.

WO 2005/097349 is an other document which discloses an alike device without disclosing integration into a final device providing leak-tightness, fluidic optimisation and low cost.

Document WO 2005/024967 discloses a piezo-actuator for miniaturized pumps which according to FIGS. 1 to 6 includes a weak point, item 6 and 9, which helps in this case to accommodate the bending, hence the pumping motion of the piezo-element and thus the efficient filling and emptying of the cavity containing the liquid.

Document WO 2004/031580 discloses a micropump using the same principle by providing a support ring to isolate the actuator from the housing as shown with item 4*a* in FIG. 3*a* and by FIGS. 3*b* to 3*d* of this document.

Document US 2005/0201870 discloses a dosing device for dispensing a medium into an environment. The document describes another liquid droplet spray device and specifically shows in FIG. 1 a dosing aperture arrangement 5 made of silicon which is introduced into an upper part 3, also called wall portion, and secured with an adhesive connection 14 as disclosed in some of the previously cited documents. This document states in particular, that the specific production process for integration of the dosing aperture arrangement into the upper part can be chosen independently from the other portions of the device and that the process can be specially suitable for the dosing aperture arrangement. The document also discloses the provision of an elasticity zone on a second wall portion on which the vibration means is provided. The elasticity zone is laid out as a circular groove and provided to avoid at least substantially reduce unwanted transmission of oscillation to other parts of the device in a similar fashion as previously cited documents. Nevertheless and obviously the wall portion is later assembled in direct contact and rigidly into the other housing parts via a leak-tight, cohesive connection between parts and by means of adhesive bonding, ultrasound or laser welding. (See FIGS. 1, 2 and 4 of the document). However, the ultrasonic oscillation being represented by essentially planar ultrasound waves, the ultrasound energy will obviously nevertheless be transmitted to all connected parts via this rigid connection between parts, even if the rigidity is provided by a form-fit arrangement. The document further discloses a combination of circular and meandering channel to supply the liquid to the dosing space under the dosing aperture which in this case is a nozzle plate. The document clearly states that the circular and annular channel is of a substantially larger volume than the dosing space which has a height of approximately 50 μm. It is therefore obvious that the channel height is substantially bigger than the dosing chamber. This would imply that the channel is used mainly for priming and dosage storage reasons but would not retain the liquid close to and in fluidic contact with the dosing space once the device is in function. The document further mentions over-moulding of the aperture arrangement and of the vibration means and multi-component injection moulding.

Document EP 1 602 414 describes an ultrasonic atomizer utilizing surface acoustic waves. The atomizer comprises an oscillator generating surface acoustic waves, and a perforated porous thin plate arranged on an oscillating surface of the oscillator with a small clearance. Liquid is aspirated into the small clearance part between the oscillator and the porous thin plate by vibration by the surface acoustic waves or by capillarity. Vibration of the surface acoustic waves is transmitted to the porous thin plate through the liquid in the small clearance part, and a small quantity of liquid penetrates into the perforations, i.e. the outlet nozzles of this thin plate and is atomized by the vibration and sprayed to the exterior.

As will be explained later, Applicant has found that, contrary to what is stated in previously cited documents, the aperture arrangement indeed needs to be machined specifically to conform to an industrial production environment, specifically an injection moulding process and also to the specific functionalities of the devices, like chemical resistance to various liquids, fluidic optimisation, leak-tightness and the like.

Applicant has found that neither the circular groove elasticity zone nor a weak point nor multi-component injection moulding are necessary to provide an efficient, leak-tight, fluidically optimised and cost-effective device and that capillary feeding methods need to be innovated.

If channels are used for system priming and dose storage then clearly different designs for capillary feed need to be invented in order to maintain the liquid feed to the chamber or even to avoid flow back. To guarantee dimensions smaller than or substantially equal to 50 μm with reasonable tolerances using a filter membrane disk as disclosed in previously cited documents is another problem.

Applicant has found that for some liquids with a viscosity of for example approximately 3 cps (centipoises) a height of 50 μm is an upper limit for capillary flow and retention, meaning avoiding flow-back due to inclination, device handling and the like. Applicant has also found that under certain conditions and specifically with constructions where the channel height is larger than the dosing space height, maintaining the chamber filled under all conditions is highly unreliable and subject to rupture of the liquid column.

It is, therefore, an object of the present invention to provide an innovative droplet spray device and an innovative production and assembly method for such a device that overcomes the inconveniences presented by the prior art documents.

SUMMARY OF THE INVENTION

Thus, the present invention concerns the construction of an innovative and inventive dispenser device fulfilling these objectives efficiently and in various embodiments which may be obtained in a relatively simple and inexpensive manner.

Thanks to the construction of the innovative and inventive dispenser device according to the present invention an efficient device fulfilling these objectives in various embodiments may be obtained in a relatively simple and inexpensive manner.

Furthermore, due to the specific design of the device according to the present invention, it is possible to easily exchange the reservoir without any unwanted spill or wastage of liquid contained in the reservoir.

BRIEF DESCRIPTION OF THE DRAWINGS

Other features and advantages of the liquid droplet spray system according to the present invention will become clear from reading the following description, which is given solely by way of a non-limitative example thereby referring to the attached drawings in which.

DETAILED DESCRIPTION OF THE INVENTION

Examples of preferred embodiments will now be described. Generally, the volatile liquid droplet dispenser device according to the present invention comprises a first substrate, also called a top packaging, and a second substrate, also called a bottom packaging, mounted one onto the other, and arranged to receive liquid from a liquid reservoir. The assembled device is also called an atomiser, as it is arranged to atomise, i.e. to create a liquid droplet spray of the liquid received from the reservoir.

Figure 1A:
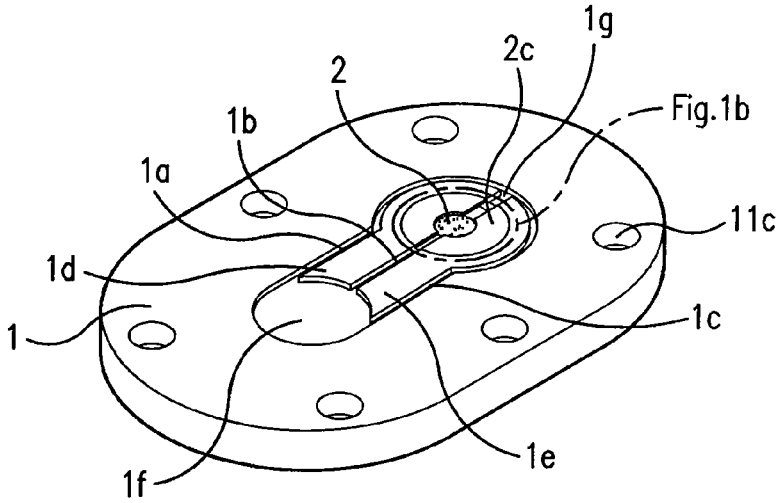
FIG. 1*a* shows an example of a perspective view of a first substrate of a volatile liquid dispenser device according to a first embodiment of the present invention.

As shown in FIG. 1*a*, a first substrate 1 comprises a liquid receiving section if that may receive liquid substance from a reservoir, either internal or external to the volatile liquid dispenser device. This receiving section if may also be configured as an internal reservoir for the liquid substance, allowing for a totally disposable top substrate. The liquid substance can flow from the liquid receiving section if to liquid outlet means 2*a* provided in the first substrate.

First substrate 1 further comprises a space 2*c* for receiving and containing the liquid substance, and comprises liquid outlet means 2*a* for ejecting liquid substance from the volatile liquid dispenser device. Space 2*c* is arranged proximate to liquid outlet means 2*a* such that the liquid substance may exit the space of the device by traversing liquid outlet means 2*a*, as will be explained in more detail later.

First substrate 1 has an outside surface 1*a* (not shown) and an inside surface 1*b*, as shown in FIG. 1*a*. Inside surface 1*b* has a recessed portion which constitutes space 2*c* for receiving the liquid substance from the reservoir. This space is important for all embodiments to reach a first objective of the invention which relates to limiting passive evaporation and thus olfactory fatigue. In this embodiment, the liquid is supplied to space 2*c* laterally by capillarity within substantially the main horizontal plane. Since the capillary pressure which supplies the liquid laterally into the space is not high enough to overcome the adhesion forces between the liquid and the substrate material, the liquid remains inside when the device is not activated and the combined open surface of the nozzles, the only surface available for evaporation of the volatile liquid is very small compared to the internal surface of the space. The ratio can be as small as 1.8E-5 depending on the nozzle diameters and density. A venting channel 1*g* may further be provided within first substrate 1 for locating the spray head 2 together with the liquid outlet means 2*a*.

Thus, surrounding space 2*c* are capillary retention zones 1*d*, 1*e* which facilitate the fluidic transportation of the liquid substance from the liquid receiving section if to space 2*c*. These zones have high capillary retention, preventing liquid from flowing back into the reservoir, i.e. from flowing away from space 2*c*.

Figure 1B:
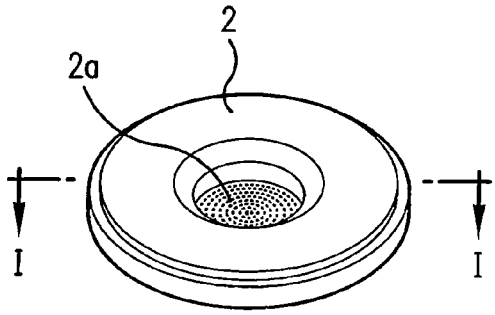
FIG. 1*b* shows the spray head of the first substrate of FIG. 1*a* in greater detail.
Figure 1C:
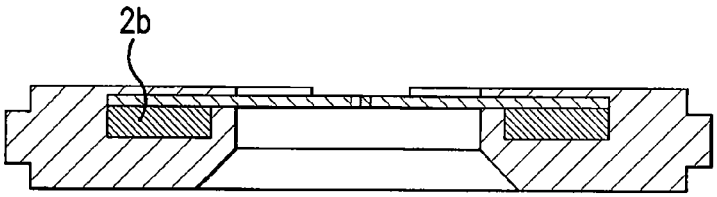
FIG. 1*c* shows a cross-sectional view of the spray head in FIG. 1*b* taken along line I-I.

FIG. 1*b* further shows a detailed view of the spray head 2. Further, a detailed cross-sectional view along line I-I of FIG. 1*b* is also shown of the spray head 2 in FIG. 1*c*. As can be seen, the liquid outlet means may be formed of a perforated nozzle membrane 2*a* with a nozzle array made out of silicon, a polymer, a resin such as SU-8, Nickel, Parylen or any suitable material or combination of materials that allows for a sufficiently precise and cost-effective manufacturing of the outlet nozzle array. For example, a higher precision process, like ICP (Inductively controlled plasma etching), SU-8 spin coating, irradiation and development as well as proton or ion beam machining, may be used for manufacturing the nozzle part of liquid outlet means 2*a* than for the other parts which are less critical for fluidic performance. The perforations constitute liquid outlet nozzles and are provided such that a liquid substance may exit space 2*c* positioned below through liquid outlet means 2*a* and the volatile liquid dispenser device by traversing the one or more perforations of the perforated membrane. Outlet means 2*a* is thus fitted into the spray head 2, which is positioned into an opening of the first substrate to complete the first substrate 1 A vibrating element 2*b*, such as a piezoelectric vibrating plate, is mounted below nozzle membrane 2*a* to cause vibration of liquid in space 2*c* so as to generate a droplet spray. Such outlet means are known as such, see for example the document EP-A-0 923 957 and EP 1 273 355 in the name of the present Applicant. The properties of this arrangement and the other components of the innovative volatile liquid droplet dispenser allow to overcome most of the problems not addressed by prior art devices as will be shown further on. As is known from the prior art introduced by the same applicant, the liquid outlet means may comprise output channels that are formed by straight walled channels with a constant diameter and an immediate nozzle outlet or may comprise stepped channels with a given channel diameter and thus a reduced diameter nozzle outlet.

According to the present invention, first substrate 1 contains at least one fluidic priming channel in fluidic connection with nozzle membrane 2*a* and arranged to receive liquid substance from space 2*c* for priming the liquid substance for ejection through the outlet nozzles of nozzle membrane 2*a*. As shown in FIG. 1*a*, in this example, there are three fluidic priming channels 1*a*, 1*b*, 1*c* connecting liquid receiving section if to space 2*c*. Thanks to these priming channels, the liquid substance may more easily enter and fill space 2*c*, by capillary flow, thus ensuring presence of liquid substance ready for ejecting once the device is activated.

Figure 1D:
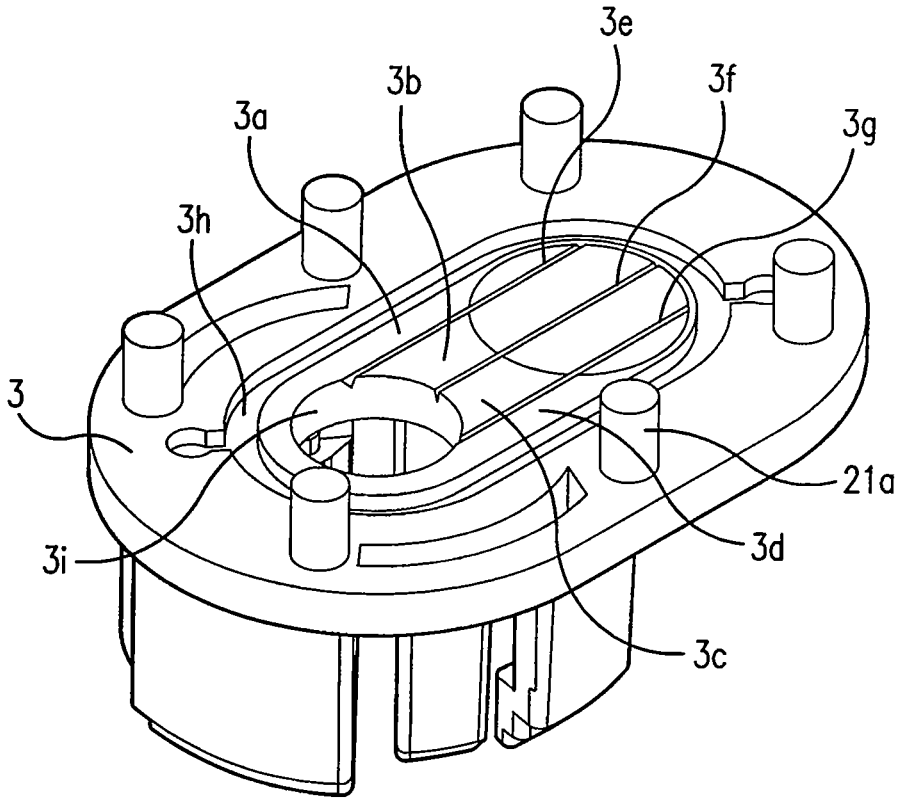
FIG. 1*d* shows a perspective view of an example of a second substrate which, together with the first substrate, forms the volatile liquid droplet dispenser device according to the first embodiment.

FIG. 1*d* shows an example of a second substrate 3, or the bottom packaging, which, together with the first substrate 1, forms the volatile liquid droplet dispenser device according to the first embodiment by assembling together these two substrates, i.e. by putting the top packaging onto the bottom packaging.

Second substrate 3 comprises connection means 3*i* for connection to a reservoir, also called a refill, containing a volatile liquid substance that is to be dispensed. In this case, connection means 3*i* may be of the screw-type having a partial inner thread for receiving the reservoir by twisting the latter into the partial thread, and may accommodate liquid inlet means provided in second substrate 3 for allowing the liquid substance to enter the volatile liquid droplet dispenser device from a reservoir. Such means are in themselves not inventive but may be a passive pump, for example a wick made a soft porous medium, that enters the reservoir to allow for extraction of the liquid into the device. Such means can also be an active pump which has a tubular rod for extending into the reservoir via a dip-tube and which pumps the liquid out of the reservoir. Liquid may thus be supplied for example from a flask, a (collapsible) bag or other reservoir directly, via a wick or a dip-tube to a pump and from the wick or the pump to the dispensing device. In the context of the invention, wick and pump are solely representative of passive and active liquid supply means. Indeed, a collapsible bag inside the reservoir could be used in a wick-less arrangement, in a manner that is well known to a skilled person. Venting means, not shown, my be provided in a known manner in the second substrate surrounding the liquid inlet means so as to facilitate the liquid flow from the reservoir into the volatile liquid dispenser device.

Figure 1E:
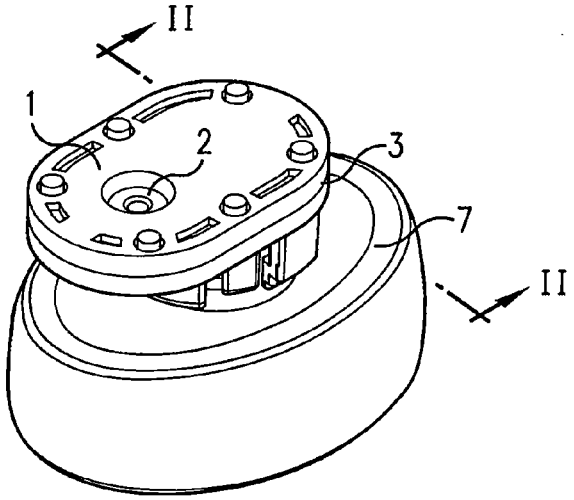
FIG. 1*e* shows a perspective view of an assembled volatile liquid droplet dispensing device according to the first embodiment, and defining line II-II.
Figure 1F:
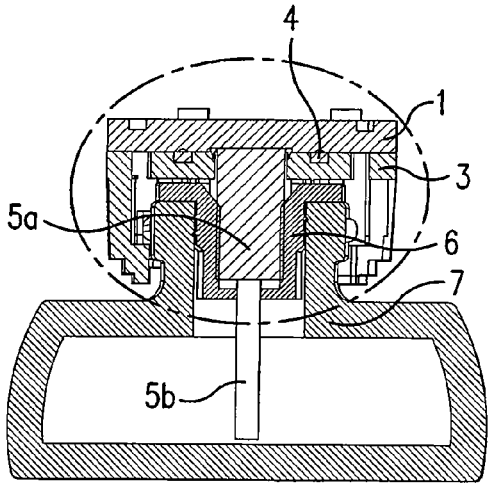
FIG. 1*f* shows a cross-section along line II-II of FIG. 1*e*, which pertains to a liquid entry section of an assembled volatile liquid droplet dispensing device according to the first embodiment, where the first and second substrates are joined to each other and mounted on an external reservoir.

As shown in FIG. 1*f*, a wick 5*a*, 5*b* is preferably arranged to enter second substrate 3 through connection means 3*i* and may extend slightly beyond the top surface of second substrate 3 so as to allow the liquid to flow into the device, by entering the liquid receiving section if of first substrate 1, as will be explained in more detail later. The person skilled in the art will recognize that, same as elsewhere in the description, discrete or bi-injection moulded gaskets are provided where needed and are not shown in the drawings for reasons of simplicity.

As can further be seen in FIG. 1*d*, several protrusions 21*a* are provided for assembling second substrate 3 to first substrate 1 by aligning the protrusions with appropriate holes 11*c* in the first substrate (see FIG. 1*a*) for joining by, for example, ultrasonic or laser welding. Of course, other means for assembling the device may be used instead, such as co-injection, gluing or the like.

According to a further aspect of the present invention, second substrate 3 comprises at least one groove for capillary retention of the liquid substance. As shown in FIG. 1*d*, in this example, second substrate 3 comprises three capillary retention grooves 3*e*, 3*f*, 3*g* each linked to connection means 3*i* which is configured to be liquid inlet means. These capillary retention grooves are provided longitudinally with respect to the device and are preferably of V-shape to allow for optimal capillary retention thanks to an improved cohesion between liquid molecules and the sidewalls of the groove. In between, and surrounding these grooves 3*e*, 3*f*, 3*g*, there are provided high capillary retention zones 3*a*, 3*b*, 3*c* and 3*d*, similar to the capillary retention zones 1*d*, 1*e* of first substrate 1. A gasket groove 3*h* is further provided in second substrate 3 for receiving a gasket 4 (see FIG. 1*f*) for making the assembled device liquid-tight.

Figure 1G:
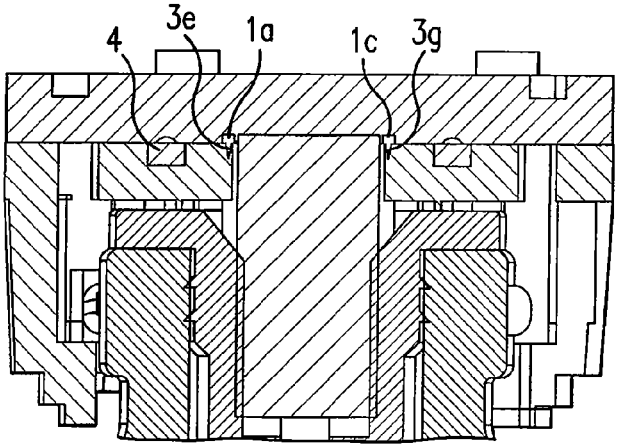
FIG. 1*g* shows an enlarged view of a portion of FIG. 1*f*.

FIG. 1*f* shows a cross-sectional view of an assembled volatile liquid droplet dispensing device, where the first and second substrates are joined to each other and mounted on an external reservoir 7. This cross-sectional view is taken along line II-II of FIG. 1*e*, and corresponds to the liquid entry section. A detailed view of a portion of FIG. 1*f* is shown in FIG. 1*g*. Liquid contained in reservoir 7 may thus flow into the device, in a known manner, and is then transported to space 2*c* of first substrate 1 principally by capillary flow. As can be seen from FIG. 1*g*, the first and second substrates are assembled in such a manner that the fluidic priming channels 1*a*, 1*b*, 1*c* of first substrate 1 are superposed and aligned with the capillary retention grooves 3*e*, 3*f*, 3*g* of the second substrate. As such, any liquid flowing into the device may easily enter space 2*c*, as flow is facilitated by the capillary channels in the first and second substrates 1 and 3. The liquid will further remain in the immediate vicinity of space 2*c* thanks to the capillary retention channels. Also, any liquid substance in priming channels 1*a*, 1*b*, 1*c* is in fluidic contact with any liquid substance in capillary retention grooves 3*e*, 3*f*, 3*g*. A gasket 4 is further shown in gasket groove 3*h*. Thus, it is possible to ensure that space 2*c* is always filled with liquid, once a reservoir is connected of course, so as to allow for correct operation of the device when it is activated. As shown in this example, a reservoir 7 is connected by way of a wick 5*a*, 5*b* to a wick plug 6 so that liquid may enter liquid receiving section 1*f*.

Indeed, contrary to prior art devices, there is no risk of liquid flowing back out of the space, due to for example gravity or other forces, which would lead to an empty or only partially-filled space. In such a case, when the prior art device is activated, chances are high that no liquid spray would be produced because the force necessary to transport the liquid to the liquid outlet means would be too high thus resulting in a malfunctioning of the device. The present invention overcomes also this problem by ensuring a filled space and liquid near the outlet nozzles of the perforated nozzle membrane plate thanks to the priming channels.

Figure 1H:
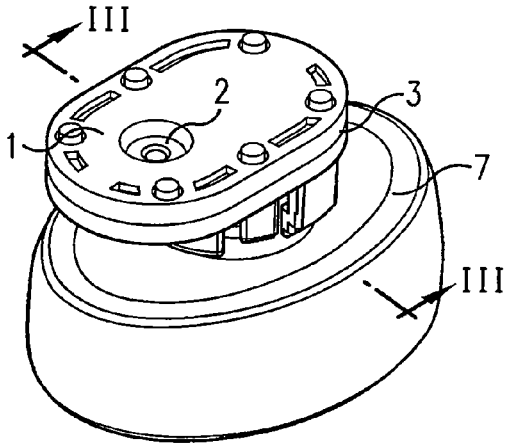
FIG. 1*h* shows a perspective view of an assembled volative liquid droplet dispensing device according to the first embodiment, and defines line III-III.
Figure 1I:
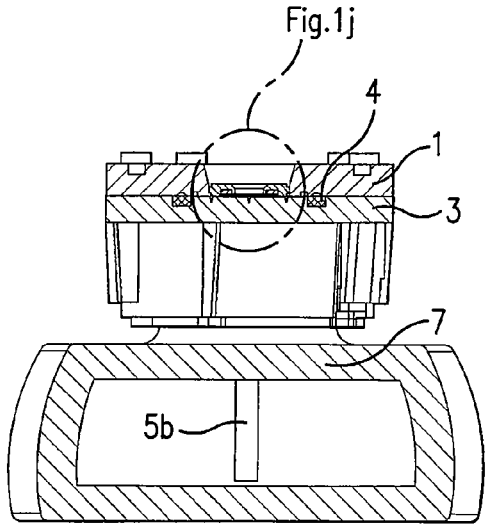
FIG. 1*i* shows a cross-section along line III-III of FIG. 1*h*, in order to show the nozzle membrane of an assembled volatile liquid droplet dispensing device according to the first embodiment.

FIG. 1*i* shows another cross-section view of the assembled droplet spray device, similar to the device of FIG. 1*f*, but this time the cross-section is along the nozzle membrane, along line III-III of FIG. 1*h*. Again, an enlarged detailed view is shown in FIG. 1*j*.

Figure 1J:
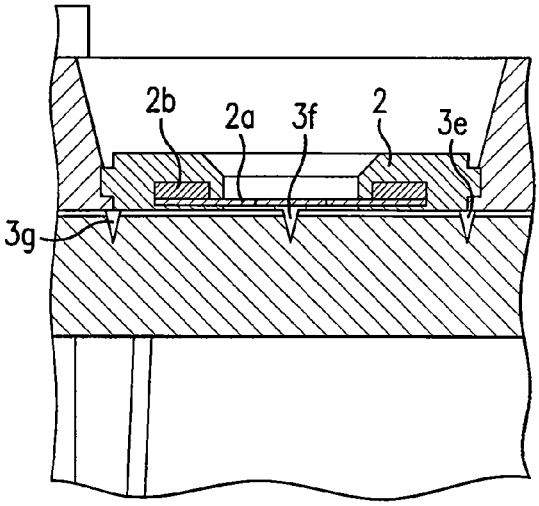
FIG. 1*j* shows an enlarged view of a portion of FIG. 1*h*.

Again, it is clear, from FIG. 1*j*, that the first and second substrates are assembled in such a manner that the fluidic priming channels 1*a*, 1*b*, is of first substrate 1 are superposed and aligned with the capillary retention grooves 3*e*, 3*f*, 3*g* of the second substrate.

Figure 2A:
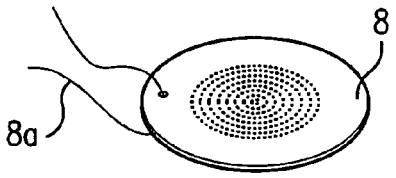
FIG. 2*a* shows a perspective view of an alternative arrangement of a nozzle membrane in a second embodiment.

FIG. 2*a* shows an alternative arrangement of a nozzle membrane in a second embodiment. In this second embodiment, the nozzle membrane is obtained by perforating a vibrating element to form a nozzle membrane actuator.

Thus, perforated vibrating element 8 may be used so as to advantageously replace the perforated nozzle membrane 2*a* and the vibrating element 2*b* of the first embodiment so form a nozzle membrane actuator 8. As may be understood, such arrangement allows for an easier assembly of the final device, as there are fewer parts.

In this example, nozzle membrane actuator 8 is provided with connection means 8*a* for powering the vibrating element so as to allow acting on the liquid substance in space 2*c* for preparing ejection of the liquid as a spray.

In this second embodiment, the first and second substrate may be identical to those described above in the first embodiment. The only change is in fact the combined membrane and vibrating element. For example, a piezoelectric element may be punched to obtain through-holes that constitute the outlet nozzles of the spray device.

In this example, nozzle membrane actuator 8 is provided with connection means 8*a* for powering the vibrating element so as to allow acting on the liquid substance in space 2*c* for preparing ejection of the liquid as a spray.

Figure 2B:
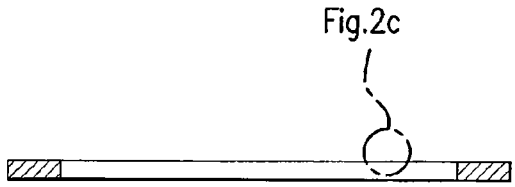
FIG. 2*b* shows a cross-sectional view of another alternative arrangement of the nozzle membrane according to FIG. 2*e*, wherein the cross-section is taken along line IV-IV of FIG. 2*e*.

FIG. 2*b* shows a detailed view of another alternative arrangement of a nozzle membrane in a third embodiment.

In this embodiment, the priming channels are provided directly in the nozzle membrane 9.

Figure 2C:
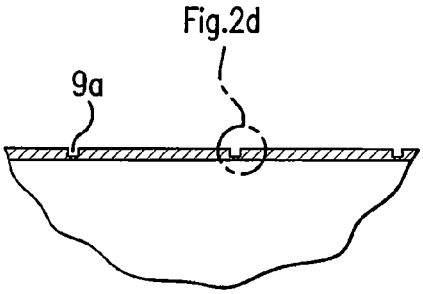
FIG. 2*c* shows an enlarged view of a portion of the nozzle membrane shown in FIG. 2*b*.
Figure 2D:
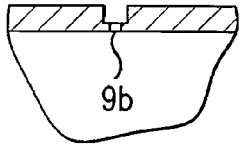
FIG. 2*d* shows a further enlarged view of a portion of the enlargement shown in FIG. 2*c*.
Figure 2E:
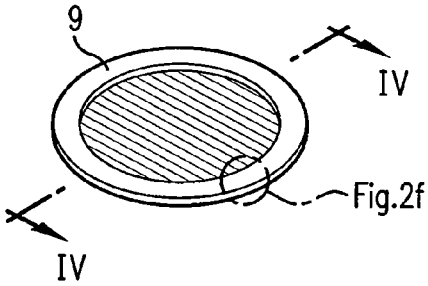
FIG. 2*e* shows a detailed view of another alternative arrangement of a nozzle membrane in a third embodiment.
Figure 2F:
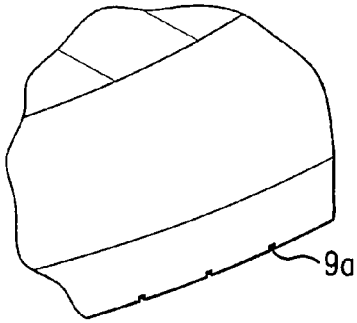
FIG. 2*f* shows an enlarged view of another portion of the nozzle membrane arrangement shown in FIG. 2*e*.

These priming channels, referenced by 9*a*, are open towards space 2*c*, and have perforations constituting outlet nozzles 9*b*, as shown in FIGS. 2*c* and 2*d*.

Each priming channel 9*a* thus also functions as a capillary channel, because liquid that enters such channel will not seep out due to capillary constraints between the liquid and the sidewalls of the channels 9*a*.

The priming channels are provided directly in the nozzle membrane 9. Preferably, here too, each priming channel is open on its side proximate space 2*c* so as to receive the liquid substance from the space, and is perforated on its opposite side so as to constitute the outlet nozzles 9*b* of the perforated nozzle membrane. Thanks to these priming channels, it is possible to ensure presence of liquid in the immediate vicinity of the outlet nozzles thus allowing for an effective operation of the device once activated, i.e. once the vibrating element starts vibrating to excite the liquid substance in space 2*c*. The second substrate in this third embodiment may be similar to that of the first embodiment, and is hence not shown here, and also contains capillary retention grooves 3*e*, 3*f*, 3*g* that are arranged so as to ensure a fluidic contact between liquid in these grooves and liquid in space 2*c*.

Figure 2G:
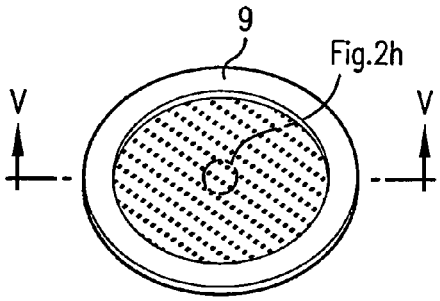
FIG. 2*g* shows a detailed perspective view of another alternative arrangement of a nozzle membrane in a fourth embodiment.

FIG. 2*g* shows a detailed view of another alternative arrangement of a nozzle membrane in a fourth embodiment. In this embodiment, the nozzle membrane is rather similar to that of the third embodiment shown in FIG. 2*d*, except for the priming channels and the outlet nozzles. Indeed, nozzle membrane 9 has slit priming channels 9*a*, as shown in FIG. 2*j* of the cross-sectional view along line V-V of FIG. 2*g*. These priming channels have the same function of those in the previous embodiment.

Figure 2H:
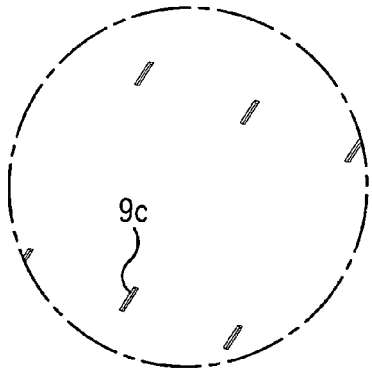
FIG. 2*h* shows an enlarged view of a portion of the nozzle membrane shown in FIG. 2*g*.
Figure 2I:
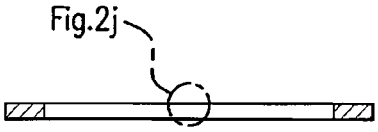
FIG. 2*i* shows a cross-sectional view of the nozzle membrane arrangement shown in FIG. 2*g* as taken along line V-V.
Figure 2J:
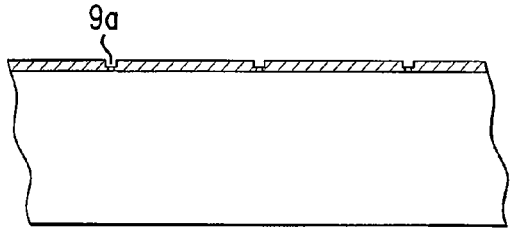
FIG. 2*j* shows an enlarged view of a portion of the cross-sectional view of the nozzle membrane shown in FIG. 2*i*, FIGS. 3*a* and 3*c* show perspective views of a further alternative arrangement of the volatile liquid droplet dispenser device according to the present invention.

However, here the outlet nozzles are not separate through-holes, but are slots 9*c*, as shown in detail in FIG. 2*h*. Thus, this nozzle membrane allows for high output slot sheet spraying, as the flow rate of outputting liquid may be much higher as compared to the previous embodiments. Such slots may be obtained, for example, by adjoining several nozzles into a bigger nozzle.

Figure 3A:
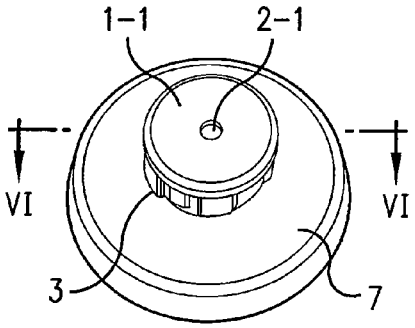
FIG. 3*b* shows a cross-sectional view, taken along line VI-VI, of the volatile liquid droplet dispenser device of FIG. 3*a*.
FIG. 3*d* shows an enlarged view of a portion of the cross-sectional view shown in FIG. 3*b*.
FIG. 3*e* shows a perspective view of a SAW transducer employed by an embodiment of the present invention.
FIG. 3*f* shows an enlarged view of a portion of FIG. 3*c*.
FIG. 3*g* shows a cross-sectional view of the SAW transducer as taken along line VII-VII of FIG. 3*e*.
FIG. 3*h* shows an enlarged view of a portion of FIG. 3*g*, FIGS. 4*a* and 4*e* show perspective views a first surface in accordance with another embodiment having a dome-shaped nozzle membrane of the volatile liquid droplet dispenser device according to the present invention.
Figure 3B:
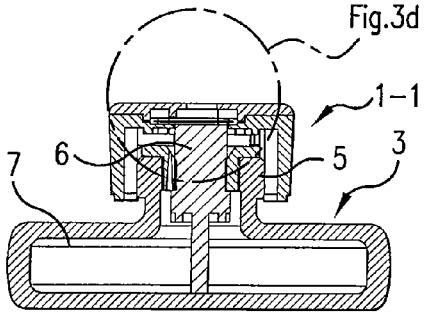
Figure 3C:
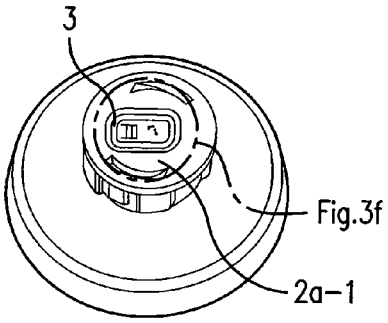
Figure 3D:
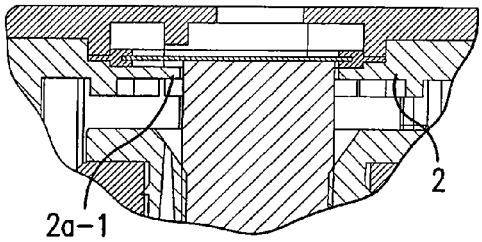
Figure 3F:
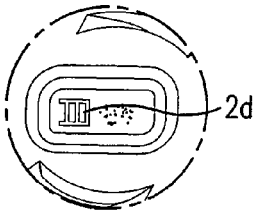
Figure 3E:
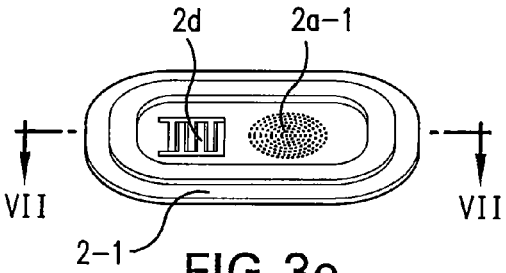

FIGS. 3*a* and 3*c* show a further alternative arrangement of the volatile liquid droplet dispenser device according to the present invention, In this example, a spray head 2-1 comprising a nozzle membrane 2*a*-1 is put into vibration by a surface acoustic wave.

In fact, the vibrating element is in the form of a surface acoustic wave (SAW) transducer 2*d*. In this embodiment, spray head 2-1 is provided with a SAW transducer 2*d* on one extremity, and with a perforated membrane section 2*a*, similar to the nozzle membrane of the first and second embodiments, on the other extremity, as can be seen in FIG. 3*c*.

SAW transducer 2*d* generates a vibrating wave, i.e. a surface acoustic wave that will cause vibration of the perforated membrane 2*a*-1 thus leading to ejection of liquid that is present in the immediate proximity of the outlet nozzles, in the same manner as in the previous embodiments.

Thus, in this third embodiment, the actual operation of the spray device is the same as in the other embodiments, only the manner of generating vibration is different, here by an SAW transducer, instead of by a piezoelectric vibrator, that causes the membrane plate to vibrate.

Figure 3G:
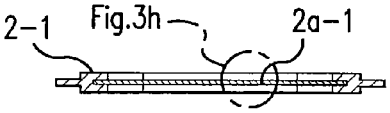
Figure 3H:
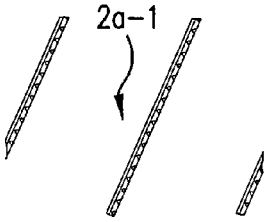

Thus, in this example shown in FIG. 3*a*, there are also priming channels arranged in nozzle membrane 2*a*-1, similar to the third embodiment. As shown in FIG. 3*h* corresponding to an enlarged view of a portion of FIG. 3*g*, capillary priming channels are provided that have outlet nozzles at their top end, so as to allow for ejection of liquid in the form of droplets, in a similar manner as in the first to third embodiment. A first substrate 1-1 is provided that is arranged to receive spray head 2-1. The second substrates 3 is similar to that of the first embodiment, and again, by assembly of these substrates, a droplet spray device according to another example may be obtained. In FIGS. 3*a* and 3*b*, the assembly is shown, where the device is mounted on a reservoir 7, and a wick 5 is provided to connect reservoir 7 to the spray device, for example by way o a wick plug 6, lime in the first embodiment.

Figure 4A:
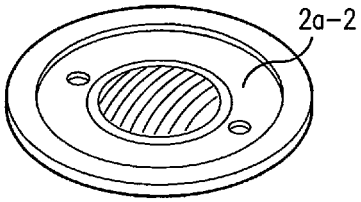
FIG. 4*b* shows a cross-sectional view of the dome-shaped nozzle membrane of FIG. 4*a* when it is assembled in the volatile liquid drop dispenser device.
FIG. 4*c* shows an enlarged view of a portion of FIG. 4*b*.
FIG. 4*d* shows a perspective view of a second surface of the dome-shaped nozzle membrane shown in FIG. 4*a*.
FIG. 4*f* shows a perspective sectional view of the dome-shaped nozzle membrane of FIG. 4*e* when it is assembled in the volatile liquid drop dispenser device.
FIG. 4*g* shows a perspective view of a second surface of the dome-shaped nozzle membrane shown in FIG. 4*e*.
FIG. 4*h* shows an enlarged cross-sectional view of a portion of the dome-shaped nozzle membrane shown in FIG. 4*f*, FIGS. 5*a* and 5*f* show another embodiment of the volatile liquid droplet dispenser device according to the present invention.
Figure 4B:
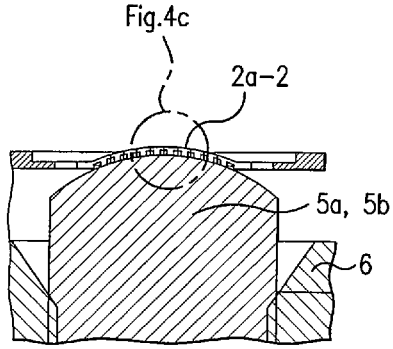
Figure 4C:
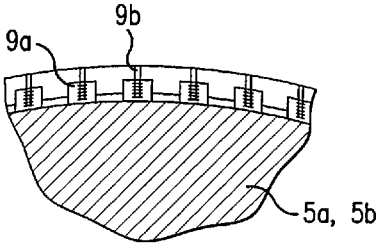
Figure 4D:
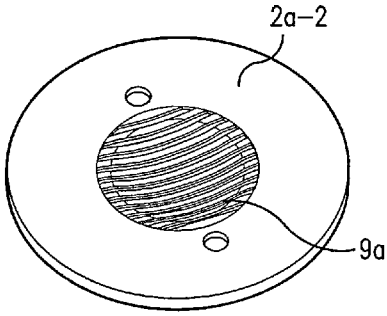
Figure 4E:
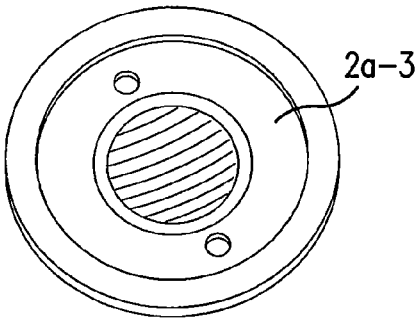
Figure 4F:
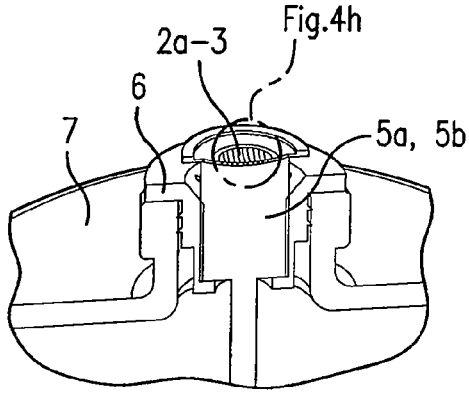
Figure 4G:
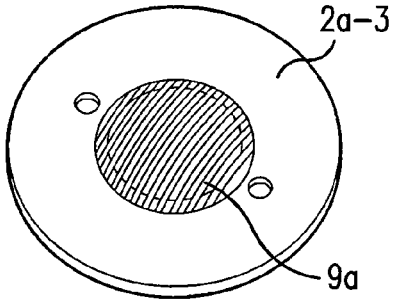
Figure 4H:
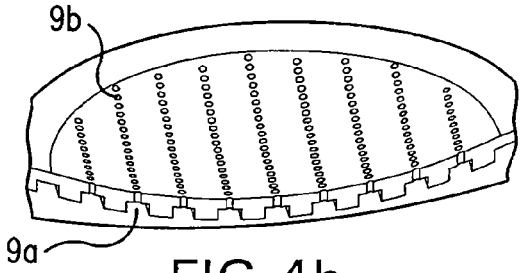

FIGS. 4*a* and 4*e* show another embodiment of the volatile liquid droplet dispenser device according to the present invention where the nozzle membrane is dome-shaped. In FIG. 4*a*, a nozzle membrane 2*a*-2 is shown that has a dome-shape bulging outwards, away from the spray device. Capillary priming channels 9*a* are provided directly in the membrane, and these priming channels have outlet nozzles 9*b* allowing for passage of liquid as a droplet spray, in the same manner as disclosed above for the other embodiments. In this embodiment, however, the dome-shaped membrane, and its supporting section surrounding the membrane forms the top packaging, i.e. a first substrate similar to that of the first embodiment. Further, the second substrate simply consists of a wick plug 6, and possible connection means to a reservoir, for receiving a wick 5*a*, 5*b* provided directly below dome-shaped nozzle membrane 2*a*-2, as shown in the FIGS. 4*a* and 4*b*. This wick is configured to receive liquid substance from a reservoir 7, and thus will fill with liquid thus transporting the liquid towards the outlet means 2*a*-2. It may thus be understood that the priming channels have again the same function, i.e. ensuring a presence of liquid in close proximity of the outlet nozzles 9*b*.

It may be understood that such dome-shaped membrane can also be used in the first embodiment, by simply adapting spray head 2 of FIG. 1*b* by using a dome-shaped membrane instead of a flat membrane.

Here too, it is possible to combine outlet nozzles into an outlet slot to allow for sheet spraying.

FIG. 4*e* shows a variant of the arrangement shown in FIG. 4*a*, but here the nozzle membrane has an inverted dome-shape, i.e. the dome bulges inwards in this variant. Nozzle membrane 2*a*-3 is further similar in function as nozzle membrane 2*a*-2 of FIG. 4*a* in that a wick is provided directly below nozzle membrane 2*a*-3 to transport fluid towards the outlet means of the spray device. Thanks to priming channels 9*a*, with outlet nozzles 9*c*, liquid will be present in close proximity of the outlet nozzles thus ensuring a correct operation of the spray device.

Naturally, as mentioned above for the dome-shaped membrane of FIG. 4*a*, this inverted dome-shaped membrane shown in FIG. 4*e* can also be used in a device as shown in FIG. 1*a*.

Figure 5A:
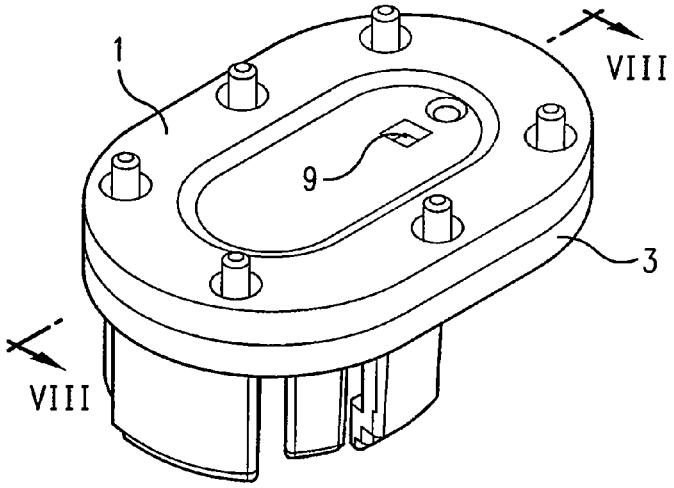
FIG. 5*b* shows a portion of a cross-sectional view taken along line VIII-VIII of FIG. 5*a*.
FIG. 5*c* shows an enlarged view of a portion of FIG. 5*b*.
FIG. 5*d* shows a perspective view of an actuator membrane.
FIG. 5*e* shows a perspective view of a piezo employed in the present invention.
FIG. 5*g* shows a cross-sectional view taken along line IX-IX of FIG. 5*f*.
FIG. 5*h* shows an enlarged view of a portion of FIG. 5*g*.
FIG. 5*i* shows an enlarged view of a portion of FIG. 5*h*, and FIGS. 6*a* to 6*f* show examples of a multiple atomiser package having several volatile liquid droplet dispenser devices according to the present invention mounted onto a same package.
Figure 5B:
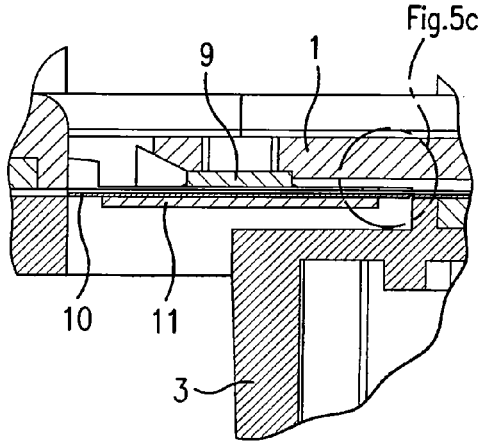
Figure 5C:
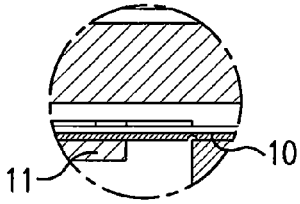
Figure 5D:
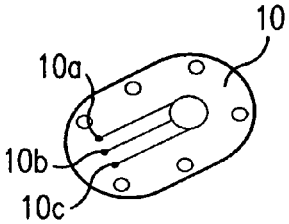
Figure 5E:
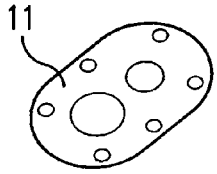
Figure 5F:
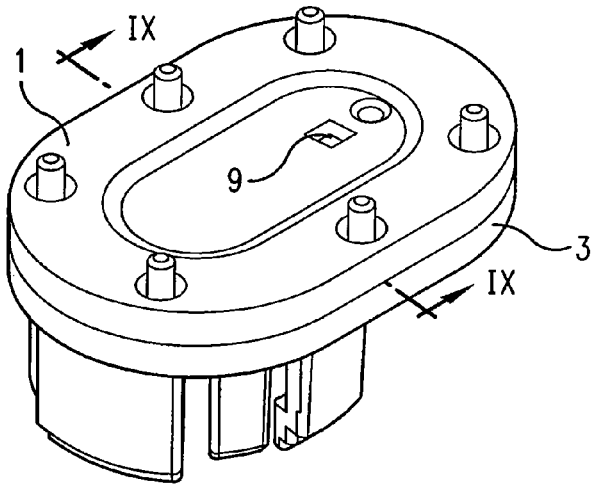

FIGS. 5*a* and 5*f* show a further alternative arrangement in which a vibrating element 11 is provided on an intermediate actuating membrane 10, Thus, the actuating membrane, when vibrated by vibrating element 11, will act on liquid in space 2*c* causing the liquid to undergo vibration and to be expelled as a spray of droplets, in the conventional manner, such as described for example in patent application PCT/EP2006/006059.

Figure 5G:
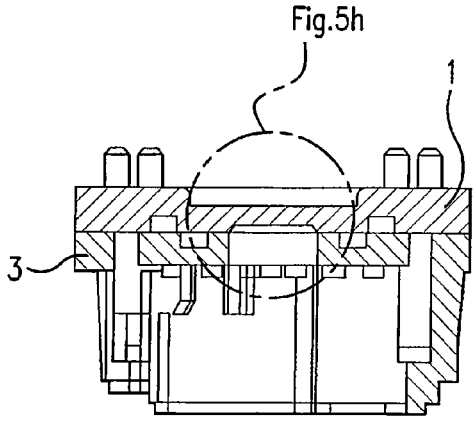
Figure 5H:
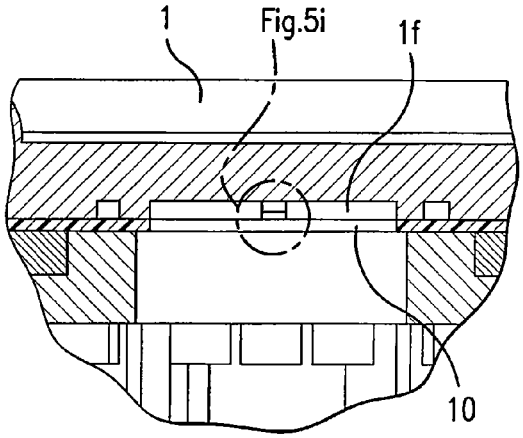
Figure 5I:
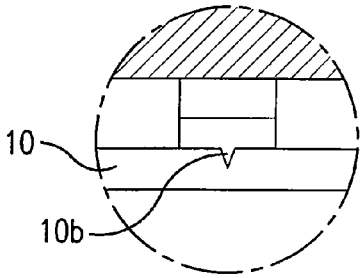

FIGS. 5*b* and 5*c* show detailed views of a cross-section cut of the spray device along line VIII-VIII, i.e. in the longitudinal direction of the assembled device. FIG. 5*g* shows a cross-sectional view along line IX-IX. Thus, in this example, actuating membrane 10 is positioned between first substrate 1 and second substrate 3, and can be actuated, i.e. put into vibration, by way of vibrating element 11, so as to allow for a more flexible positioning of vibrating element 11. The capillary retention channels that are shown in second substrate 3 in FIG. 1*d* may then be incorporated into actuating membrane 10 instead, as shown in the detailed views in FIGS. 5*d* and 5*i*, where capillary retention channels 10*a*, 10*b*, 10*c* have the same functioning as the channels 3*e*, 3*f* and 3*g* of FIG. 1*d*.

FIGS. 6*a* to 6*f* show examples of a complete packaging system combining several spray devices into one arrangement. Such arrangement may be used as a tabletop or a wall-mounted set of atomisers, having two or more atomisers, i.e. spray devices according to the present invention.

In such arrangement, a single reservoir 7 is shown that can supply liquid to several devices. Of course, reservoir 7 may be provided with sub-compartments, or reservoir 7 may consist of a plurality of separate reservoirs, one for each corresponding spray device, so that each separate device is supplied with a different substance, or each device may receive the same substance from a single, common reservoir, as the case may be. As shown in the FIGS. 6*a* to 6*f*, a spray device comprises, like in the above-described embodiments, a top packaging 1, a bottom packaging 3 and a spray head 2.

With such arrangement, a simple, Lego®-like system of a compact assembly can be obtained, and for each spray device a reservoir may be swapped out with a different one if needed in a cartridge-like manner, for example, if one of the reservoirs is empty, it can easily be swapped out with a different one. Also, if a user prefers to change a dispensing liquid, for example the user would like to use a different scent, he can then simply take out the reservoir with the scent that does not please anymore, and replace it by another reservoir having a different scent. Alternatively, a complete spray device together with reservoir may also be swapped out, or even only a spray device itself may be swapped with another one.

Thus, this multiple set allows for interchangeability of a reservoir, or of a reservoir and a spray device, or of a spray device, thus providing maximum flexibility and choice for a user.

Figure 6A:
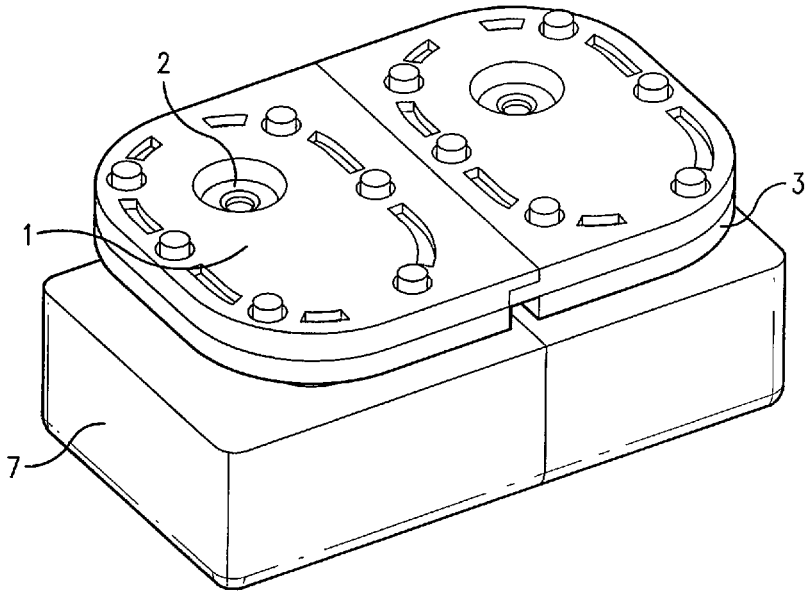
Figure 6B:
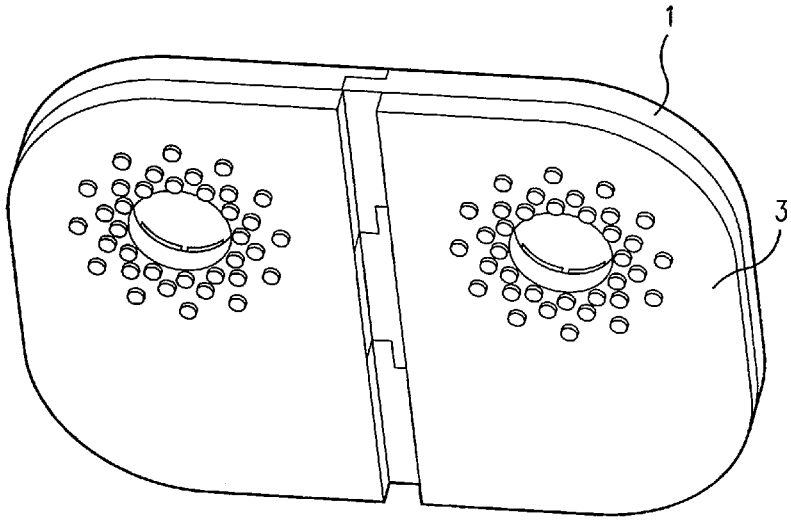

FIGS. 6*a* and 6*b* show an example of a set of two devices, each device being easily fixed to each other and to the reservoir 7.

Figure 6C:
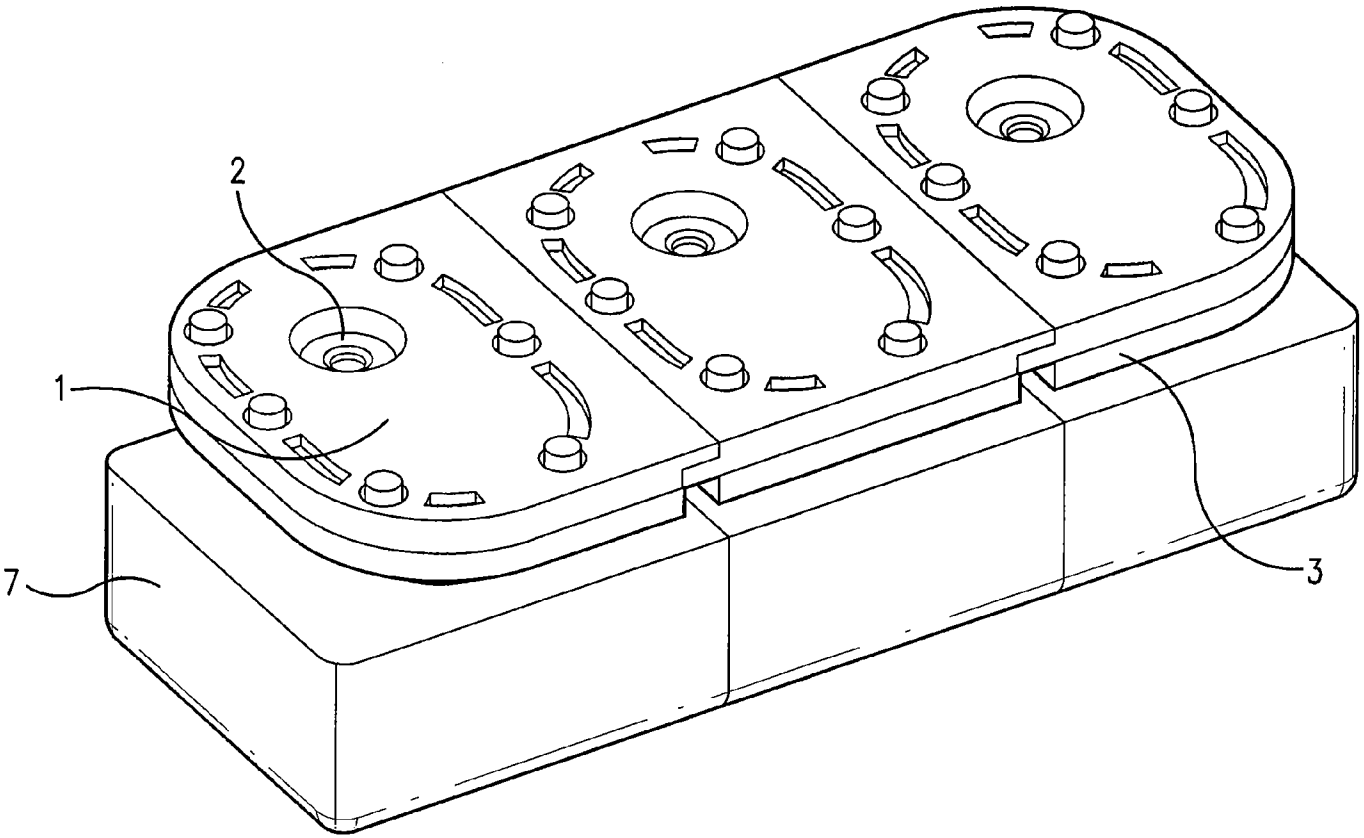
Figure 6D:
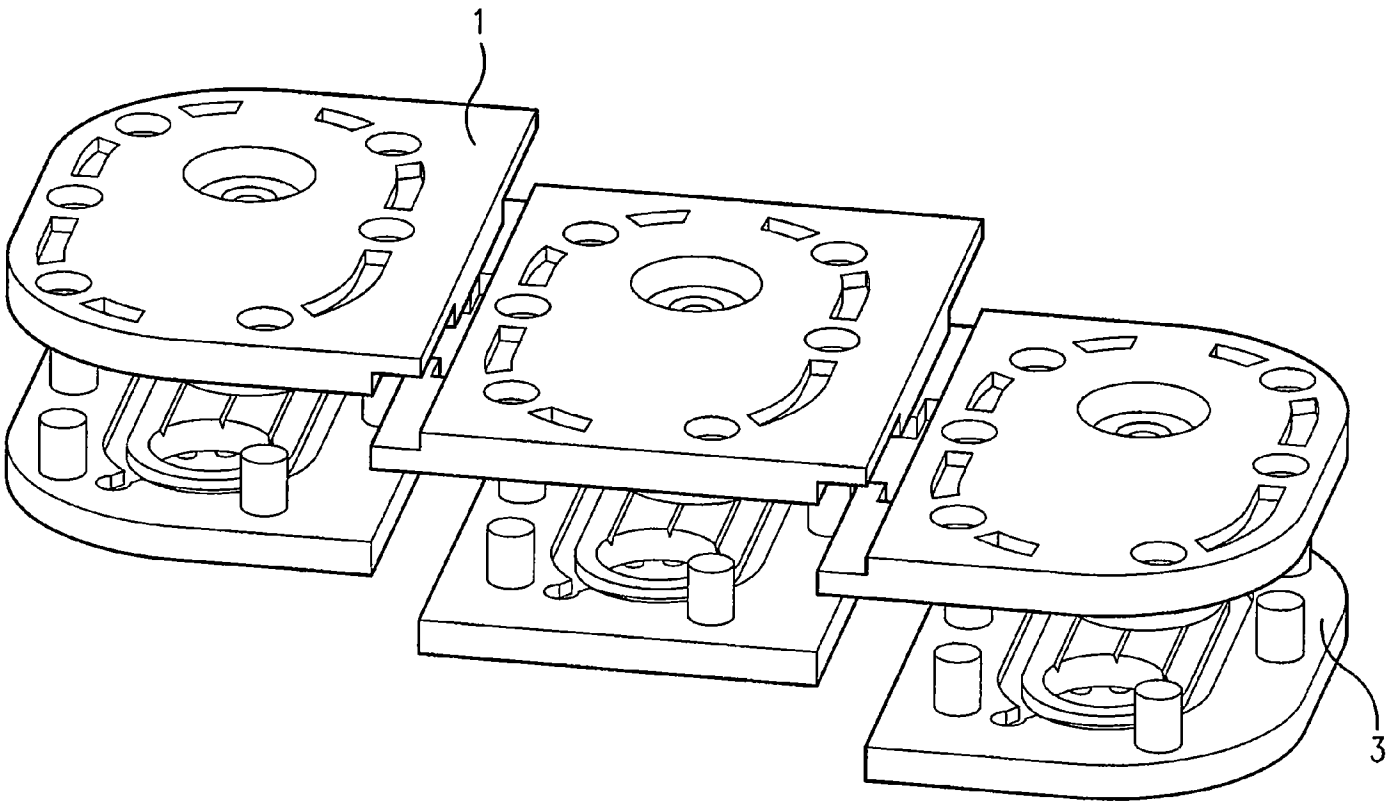

In FIGS. 6*c* and 6*d*, an example is shown with three devices, where the two end devices are identical to those shown in FIGS. 6*a* and 6*b*, and where an additional intermediate device is provided that can be readily fitted between the end devices. Of course, it is possible to add additional other intermediate devices, so to further extend the set of atomisers, if desired.

In these examples, each separate device is interconnected with another to allow for control of spraying operation by suitable electronic control means.

Figure 6E:
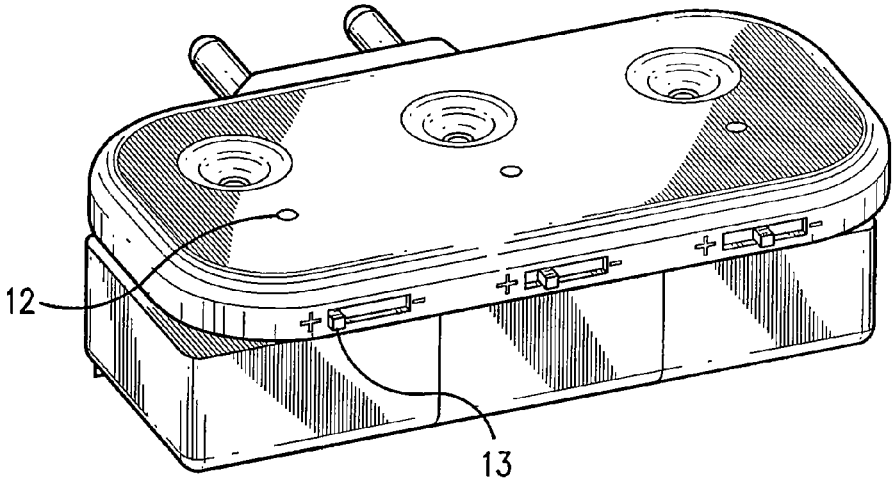
Figure 6F:
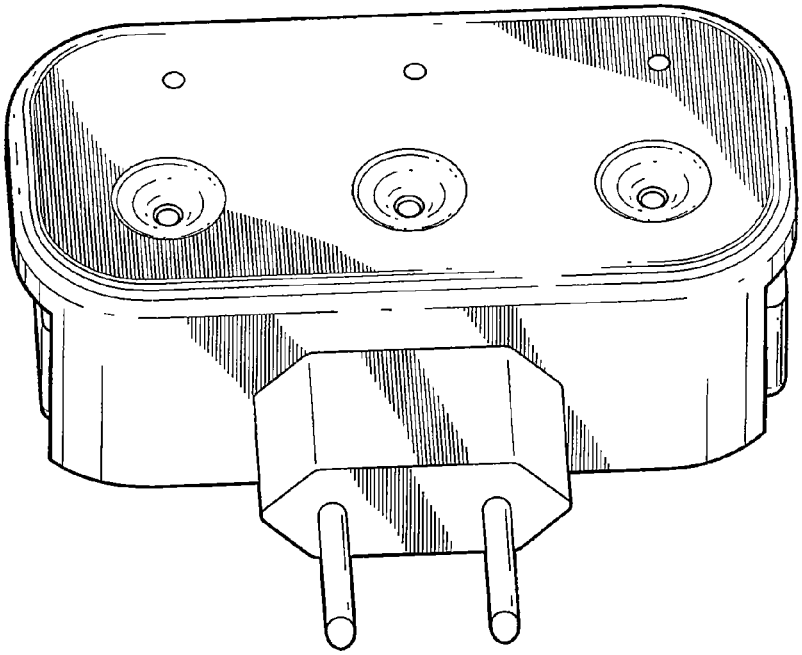

FIGS. 6*e* and 6*f* show another example of a set of atomisers in a plug-in variant. This set comprises a plug integrated into the arrangement thus allowing for direct plugging into a wall socket to power the atomiser set. Advantageously, an indicator 12 may be provided that shows if a reservoir is empty or full, Of course, such indicator may be provided for each spray device. Further, an intensity regulating means 13 may also be provided, allowing varying of the throughput of sprayed liquid thus allowing a user to vary the diffusion of liquid spray according to personal preference.

Having described now the preferred embodiments of this invention, it will be apparent to one of skill in the art that other embodiments incorporating its concept may be used. It is felt, therefore, that this invention should not be limited to the disclosed embodiments, but rather should be limited only by the scope of the appended claims.

The invention claimed is:

1. A volatile liquid droplet dispenser device for connection with a reservoir containing a liquid substance to be dispensed, the device comprising:

(a) a first substrate having a space for containing said liquid substance;

(b) liquid outlet means for ejecting liquid substance from said device, wherein said space is arranged proximate to said liquid outlet means so that liquid substance may exit the space of the device by traversing said liquid outlet means;

(c) a second substrate containing connection means arranged to receive said reservoir, and having a liquid inlet means for allowing said liquid substance to enter said device from said reservoir; and (d) an actuating element arranged on the liquid outlet means to cause vibration of liquid substance in said space so that vibrating liquid substance contacts the liquid outlet means and then exits said device as a liquid droplet spray generated by vibration, wherein the liquid outlet means of said first substrate comprises a perforated nozzle membrane having a plurality of outlet nozzles, wherein said first substrate contains at least one fluidic capillary priming channel arranged to receive said liquid substance from said space so as to fill the channel so that said liquid substance is in close proximity to said outlet nozzles for priming said liquid substance for ejection through said nozzle membrane, and wherein said at least one fluidic capillary priming channel is formed directly in said nozzle membrane of the liquid outlet means of said first substrate.

2. A volatile liquid droplet dispenser device according to claim 1, wherein said first substrate further comprises capillary retention zones to prevent said liquid substance from flowing away from said liquid outlet means.

3. A volatile liquid droplet dispenser device according to claim 1, wherein said first substrate contains more than one of said fluidic capillary priming channels.

4. A volatile liquid droplet dispenser device according to claim 1, wherein said first substrate contains three fluidic priming channels.

5. A volatile liquid droplet dispenser device according to claim 1, wherein said second substrate contains at least one groove arranged to receive said liquid substance from said liquid inlet means, wherein said at least one groove is formed so as to retain said liquid substance by capillary action in said at least one groove.

6. A volatile liquid droplet dispenser device according to claim 5, wherein each of said at least one groove is arranged proximate to a corresponding one of said at least one fluidic priming channel of said first substrate so that there is fluidic contact between liquid substances in said groove and said channel.

7. A volatile liquid droplet dispenser device according to claim 1, wherein said fluidic capillary priming channel is open on a side proximate said space so as to receive said liquid substance from said space, and is perforated on an opposite side so as to constitute the outlet nozzles of said nozzle membrane.

8. A volatile liquid droplet dispenser device according to claim 1, wherein said nozzle membrane is dome-shaped.

9. A volatile liquid droplet dispenser device according to claim 1, wherein said actuating element is a piezoelectric vibrator.

10. A volatile liquid droplet dispenser device according to claim 1, wherein said actuating element is a SAW transducer.

11. A volatile liquid droplet dispenser device according to claim 2, wherein said first substrate contains more than one of said fluidic capillary priming channels.

12. A volatile liquid droplet dispenser device according to claim 2, wherein said first substrate contains three fluidic priming channels.

13. A volatile liquid droplet dispenser device according to claim 2, wherein said second substrate contains at least one groove arranged to receive said liquid substance from said liquid inlet means, wherein said at least one groove is formed so as to retain said liquid substance by capillary action in said at least one groove.

14. A volatile liquid droplet dispenser device according to claim 13, wherein each of said at least one groove is arranged proximate to a corresponding one of said at least one fluidic priming channel of said first substrate so that there is fluidic contact between liquid substances in said groove and said channel.

15. A volatile liquid droplet dispenser device according to claim 5, wherein said at least one groove is formed in a V-shape so as to retain said liquid substance by capillary action in said at least one groove.

16. A volatile liquid droplet dispenser device according to claim 1, wherein said first substrate further comprises a venting channel provided within said first substrate, wherein the venting channel is disposed to locate a spray head together with the liquid outlet means.

* * * * *